US010743663B2

(12) United States Patent
Sickles

(10) Patent No.: US 10,743,663 B2
(45) Date of Patent: Aug. 18, 2020

(54) SEISMIC BASEPLATE

(71) Applicant: INTERMETRO INDUSTRIES CORPORATION, Wilkes-Barre, PA (US)

(72) Inventor: Willard J. Sickles, Dalton, PA (US)

(73) Assignee: INTERMETRO INDUSTRIES CORPORATION, Wilkes-Barre, PA (US)

( * ) Notice: Subject to any disclaimer, the term of this patent is extended or adjusted under 35 U.S.C. 154(b) by 299 days.

(21) Appl. No.: 15/510,919

(22) PCT Filed: Sep. 17, 2015

(86) PCT No.: PCT/US2015/050685
§ 371 (c)(1),
(2) Date: Mar. 13, 2017

(87) PCT Pub. No.: WO2016/044592
PCT Pub. Date: Mar. 24, 2016

(65) Prior Publication Data

US 2017/0273458 A1 Sep. 28, 2017

Related U.S. Application Data

(60) Provisional application No. 62/052,755, filed on Sep. 19, 2014.

(51) Int. Cl.
*A47B 91/00* (2006.01)
*A47B 91/02* (2006.01)
(Continued)

(52) U.S. Cl.
CPC ..... *A47B 91/005* (2013.01); *A47B 91/02* (2013.01); *A47B 91/022* (2013.01); *A47B 91/08* (2013.01);
(Continued)

(58) Field of Classification Search
CPC ..... E04G 25/06; E04G 25/061; E04G 25/065; E04G 25/063; E04G 25/04; F16M 7/00;
(Continued)

(56) References Cited

U.S. PATENT DOCUMENTS 287,913 A * 11/1883 Dawson et al. ..... A47B 91/024 248/188.4
1,255,427 A 2/1918 Jones
(Continued)

FOREIGN PATENT DOCUMENTS

CN 202276989 U 6/2012
CN 103355966 A 10/2013
(Continued)

OTHER PUBLICATIONS

International Search Report and Written Opinion of the ISA for PCT/US15/50685, ISA/US, Alexandria, Virginia, dated Dec. 21, 2015.
(Continued)

*Primary Examiner* — Hiwot E Tefera
*Assistant Examiner* — Taylor L Morris
(74) *Attorney, Agent, or Firm* — Harness, Dickey & Pierce, P.L.C.

(57) ABSTRACT

A mount may include a base having a socket. A leveler may be positioned within the socket and may be configured to be adjustably engaged to one of a plurality of posts of a shelving system. A fastener may secure the leveler to the socket. The leveler may be adjusted to change the height of the post in relation to other of the plurality of posts in the shelving system, and thereby level the shelving system.

26 Claims, 9 Drawing Sheets

(51) Int. Cl.

| | |
|---|---|
| ***A47B 91/08*** | (2006.01) |
| *E04G 25/06* | (2006.01) |
| *A47B 96/00* | (2006.01) |
| *A47B 97/00* | (2006.01) |

(52) U.S. Cl.
CPC ..... *A47B 96/00* (2013.01); *A47B 2097/008* (2013.01); *E04G 25/06* (2013.01); *E04G 25/061* (2013.01)

(58) Field of Classification Search
CPC ... F16M 11/28; F16M 11/046; E04F 15/0247; A47B 91/022; A47B 91/024; A47B 91/028; A47B 91/02; A47B 91/005; A47B 91/08
USPC .... 248/650, 188.4, 354.5, 677, 126.6, 126.7
See application file for complete search history.

(56) References Cited

U.S. PATENT DOCUMENTS 1,539,112 A 5/1925 Gloekler
2,532,168 A * 11/1950 Jakoubek ..... E21D 15/24 248/354.3
2,548,844 A * 4/1951 Myers ..... B66F 3/08 248/354.3
2,725,210 A * 11/1955 Swartz ..... E04G 25/06 248/354.3
3,356,324 A * 12/1967 Attermeyer ..... F16M 7/00 248/188.4
3,398,933 A * 8/1968 Haroldson ..... A47B 91/022 248/354.3
3,430,910 A * 3/1969 Bowden ..... E04G 25/065 254/100
3,603,547 A 9/1971 Hills
3,647,173 A * 3/1972 Pipala ..... E04G 11/46 248/354.1
3,669,393 A 6/1972 Paine et al.
3,713,259 A * 1/1973 Tkach ..... E04B 1/0007 248/352
3,797,793 A * 3/1974 Moritz ..... E04G 17/16 248/295.11
3,870,268 A * 3/1975 Larkin ..... E04G 25/04 248/354.1
3,880,394 A * 4/1975 Wisecarver ..... E04G 25/06 248/354.3
4,122,645 A * 10/1978 Tooley ..... E04G 11/486 52/651.1
4,258,516 A * 3/1981 Mori ..... E04F 15/02476 52/126.6
4,313,586 A * 2/1982 Grzesnikowski .... A47B 91/024 248/188.4
4,348,841 A * 9/1982 Ueno ..... E04D 3/351 52/126.5
4,405,111 A * 9/1983 Lennon ..... E04C 3/02 211/105.4
4,546,580 A * 10/1985 Ueno ..... E04D 11/005 52/126.1
4,785,593 A * 11/1988 Munoz, Jr. ..... E02D 27/42 52/126.1
4,914,875 A * 4/1990 Gustafson ..... E04B 1/34352 52/126.6
4,966,345 A * 10/1990 Bersier ..... E04G 25/06 248/354.3
4,991,238 A * 2/1991 Forrest ..... E04H 4/084 4/498
5,000,416 A 3/1991 Fantasia
5,116,004 A * 5/1992 Luecke ..... F16M 11/28 248/157
5,205,690 A * 4/1993 Roth ..... E04B 1/4121 411/180
5,292,095 A * 3/1994 Cattaneo ..... A47B 91/028 248/188.4
5,590,863 A * 1/1997 Sasaki ..... E04G 17/14 248/354.3
5,596,934 A * 1/1997 Hamm ..... E05G 1/08 109/50
5,758,854 A * 6/1998 Shih ..... E04G 25/06 248/354.3
5,842,678 A * 12/1998 Svejkovsky ..... F16M 7/00 248/650
5,862,635 A 1/1999 Linse et al.
5,899,422 A * 5/1999 Eke ..... A47C 3/38 108/144.11
5,979,854 A * 11/1999 Lundgren ..... E04F 21/1822 248/354.3
5,988,574 A * 11/1999 Podgorski ..... A47B 91/06 248/188.4
6,024,330 A 2/2000 Mroz et al.
6,135,401 A * 10/2000 Chen ..... A47B 91/028 248/188.4
6,142,431 A * 11/2000 Herzog ..... A47B 91/024 248/188.4
6,152,424 A * 11/2000 Lapat ..... B66F 3/08 254/133 A
6,158,706 A * 12/2000 Johnson ..... E04G 25/06 248/188.4
6,256,939 B1 * 7/2001 Snyder ..... E04D 11/007 52/126.6
6,256,940 B1 * 7/2001 MacKarvich ..... E02D 27/02 52/126.6
6,279,880 B1 * 8/2001 Hawks, Jr. ..... E04G 21/3219 256/67
6,347,489 B1 * 2/2002 Marshall, Jr. ..... E02D 27/00 248/354.5
6,354,231 B1 * 3/2002 Morris ..... A47B 91/028 108/144.11
6,394,405 B1 * 5/2002 Roxton ..... E04G 25/04 248/354.1
6,442,906 B1 * 9/2002 Hwang ..... E04F 15/0247 248/188.4
6,467,741 B1 * 10/2002 Shih ..... E04G 25/06 248/200.1
6,505,803 B1 * 1/2003 Hernandez ..... A47B 51/00 248/354.5
6,612,533 B2 * 9/2003 Biles ..... B25H 3/006 248/354.1
6,669,163 B2 * 12/2003 Davis, Jr. ..... F16M 7/00 248/188.1
6,742,750 B2 6/2004 Burr
6,863,270 B2 * 3/2005 Bartley, Jr. ..... A47B 51/00 269/37
6,935,463 B2 8/2005 Brewster
6,983,570 B2 * 1/2006 Mead ..... E04F 15/02452 248/188.2
7,086,203 B2 8/2006 Owen
7,255,059 B1 * 8/2007 McDonald ..... B63B 17/00 114/188
7,325,412 B2 * 2/2008 Yun ..... A47B 91/022 248/188.4
7,584,932 B2 * 9/2009 Shih ..... E04G 17/14 248/354.3
7,767,318 B2 8/2010 Cheng et al.
8,066,247 B2 11/2011 Spera
8,156,694 B2 * 4/2012 Knight, III ..... B66F 3/08 248/188.1
8,381,482 B2 * 2/2013 Lin ..... E04B 1/4157 52/295
9,027,898 B1 * 5/2015 Holmboe ..... E04G 25/065 248/354.4
9,222,251 B2 * 12/2015 Espinosa ..... E04B 1/4121
2003/0146355 A1 8/2003 Burr
2003/0230700 A1 * 12/2003 Kemeny ..... F16M 7/00 248/677
2004/0035064 A1 * 2/2004 Kugler ..... E04F 15/02183 52/126.6
2004/0088945 A1 5/2004 Owen
2004/0163334 A1 * 8/2004 Carlson ..... E04F 15/02 52/126.6

(56) References Cited

U.S. PATENT DOCUMENTS

2004/0211147 A1* 10/2004 Vanagan ..... E04G 7/307 52/831
2005/0056760 A1* 3/2005 Carlson ..... E04G 11/48 248/354.3
2005/0161571 A1* 7/2005 Wood ..... E04G 25/061 248/354.3
2006/0186284 A1* 8/2006 Root ..... F16B 7/1472 248/161
2007/0264076 A1* 11/2007 McCracken ..... E04G 25/061 403/315
2009/0206231 A1* 8/2009 Firman ..... A47B 91/024 248/677
2009/0211058 A1* 8/2009 Nagayama ..... F16B 23/00 16/446
2009/0250571 A1* 10/2009 Laws ..... F16B 7/105 248/188.5
2009/0266950 A1 10/2009 Spera
2010/0025556 A1* 2/2010 Rogers ..... E04G 7/20 248/296.1
2012/0042600 A1* 2/2012 Bacon ..... E04G 11/483 52/632
2012/0193591 A1* 8/2012 Huang ..... B66F 1/06 254/100
2013/0043053 A1* 2/2013 Malomi ..... B25B 13/50 173/216
2013/0313386 A1* 11/2013 Adams ..... F24C 15/086 248/188.4
2016/0032953 A1* 2/2016 Papadopoulos ..... E04G 25/065 248/188.4

FOREIGN PATENT DOCUMENTS

CN 203388530 U 1/2014
CN 106714617 A 5/2017
KR 100914148 B1 8/2009
WO 2007145000 A1 12/2007

OTHER PUBLICATIONS

International Preliminary Report on Patentability for PCT/US2015/050685, IPEA/US, Alexandria, Virginia, completed Dec. 5, 2016.
Chinese Office Action dated Dec. 2, 2019 issued in corresponding Chinese Patent Application No. 201580050687.2.

* cited by examiner

SEISMIC BASEPLATE

CROSS-REFERENCE TO RELATED APPLICATIONS

This application is a 371 National Phase of PCT/US2015/050685, published as WO 2016/044592 on Mar. 24, 2016, which claims the benefit of U.S. Provisional Application No. 62/052,755, filed on Sep. 19, 2014. The entire disclosures of the above applications are incorporated herein by reference.

FIELD

The present disclosure relates to devices for anchoring stationary equipment.

BACKGROUND

This section provides background information related to the present disclosure which is not necessarily prior art.

In areas of moderate to high seismic activity, the Uniform Building Code requires anchoring, or stabilization, for storage racks, cabinets, shelving systems, and other various stationary equipment, so as to prevent these systems from becoming moving hazards in an earthquake. Seismic anchoring is designed and constructed to anchor, or restrain, the rack, cabinet, shelf, etc., in such a manner as to resist stresses and limit deflections caused by earthquake forces.

Existing seismic anchoring systems require leveling of the unit and then cross drilling the shelving posts in the field and using clevis pins to secure the post to the baseplate. Also, different baseplates are provided to accommodate different diameter or shapes of posts.

SUMMARY

This section provides a general summary of the disclosure, and is not a comprehensive disclosure of its full scope or all of its features.

An anchoring system may include a mount having a base and a socket. The socket may be fixed to the base. A leveler may be positioned within the socket and may be configured to be adjustably engaged to one of a plurality of posts of a shelving system. A fastener may secure the leveler to the socket. The leveler may be adjusted to change the height of the post in relation to other of the plurality of posts in the shelving system, and thereby level the shelving system.

Another anchoring system may include a mount having a base and a socket. The mount may be fixed to an immovable structure. The socket may be fixed to the base and may include a first bore and a second bore spaced symmetrically apart on the socket. A leveler may have a head, a threaded portion, and a spacer. The head may be positioned within the socket and may further include a third bore extending through the head. The threaded portion may be configured to be adjustably engaged to and received within a bore of one of a plurality of posts of a shelving system. The spacer may maintain a distance between the one of the plurality of posts and the head. A fastener may have a rod and a clip. The rod may pass through the first, second, and third bores to retain the leveler in the position within the socket, and the rod may receive the clip to retain the rod within the first, second, and third bores. The leveler may be rotated clockwise or counterclockwise to adjust the location of the threaded portion within the post and thereby adjust the height of the post in relation to others of the plurality of posts to level the shelving system. The mount may be configured to be used in a seismic anchoring system to secure the shelving system to the immovable structure, especially during seismic activity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The anchoring system described herein may be used for anchoring stationary equipment, such as shelving units. While shelving units are described throughout the detailed description, one of ordinary skill in the art understands that any stationary equipment may be secured using the presently described anchoring system. The baseplate and anchoring system described herein eliminates the need for in-field drilling as required by current seismic anchoring systems. Since, in current systems, the leveling of the unit must be performed before cross drilling the shelving posts, both leveling and drilling must be performed in the field. In the disclosure herein, the baseplate removes the need for in-field drilling, and requires only the leveling to be performed in the field, reducing the time for installation, the cost, and the difficulty of installation.

Further, the baseplate and anchoring system described herein also allows one baseplate to be used for any size or shape of post, reducing the number of SKUs associated with the baseplates and the cost of production.

Figure 1:
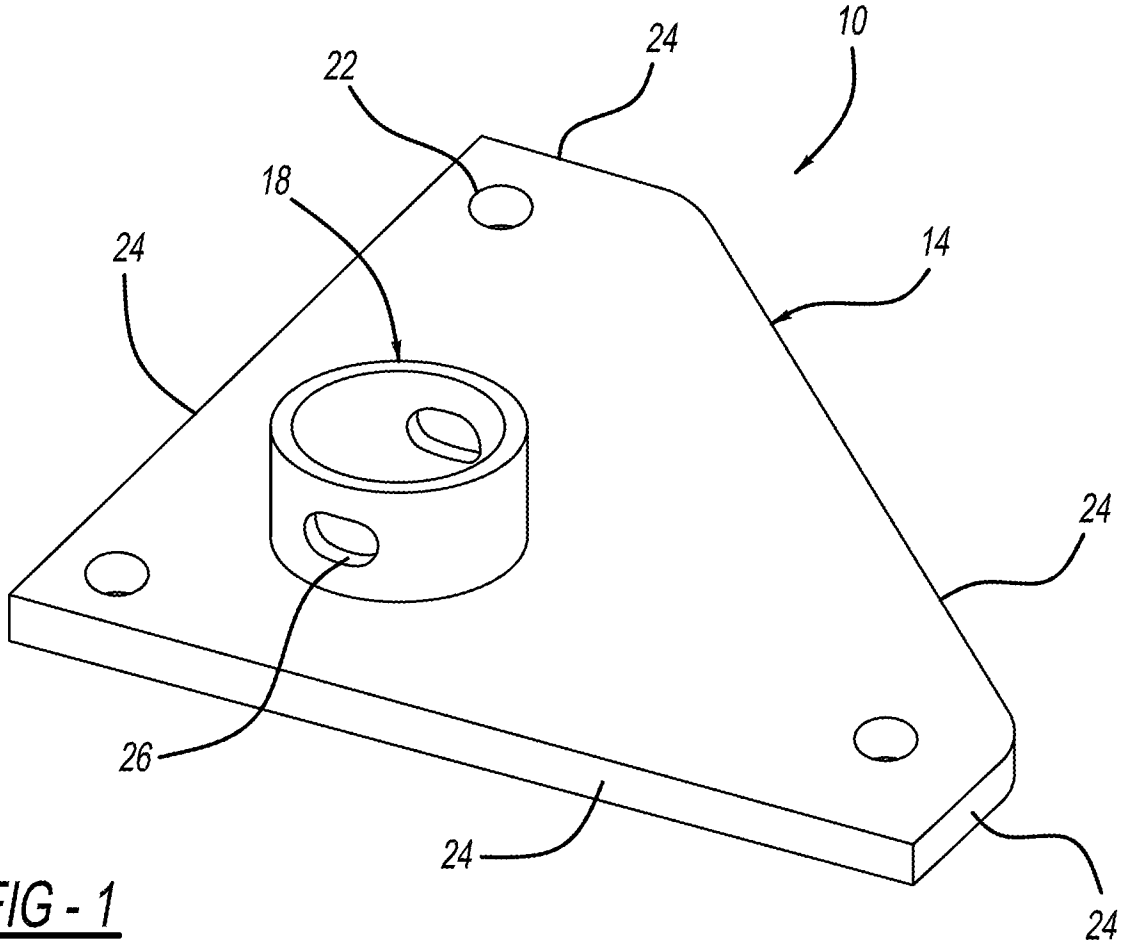
FIG. 1 is a perspective view of a baseplate according to the present disclosure.

Referring to FIG. 1, a baseplate, or mount, 10 of an anchoring system 1 is illustrated. The baseplate 10 may be used for anchoring systems subject to seismic activity, and thus may be a seismic baseplate. The baseplate 10 includes a plate, or base, 14 and a socket 18. The plate 14 may be a bolt plate that is bolted, screwed, or otherwise fixed (for example only, welded), to a stationary, or fixed, surface, or immovable structure, such as a wall or the floor. The plate 14 may be formed of a metal, such as steel, and may include a plurality of bores, or holes, 22 for receiving screw anchors, bolts, screws, or other fixation devices.

Figure 2:
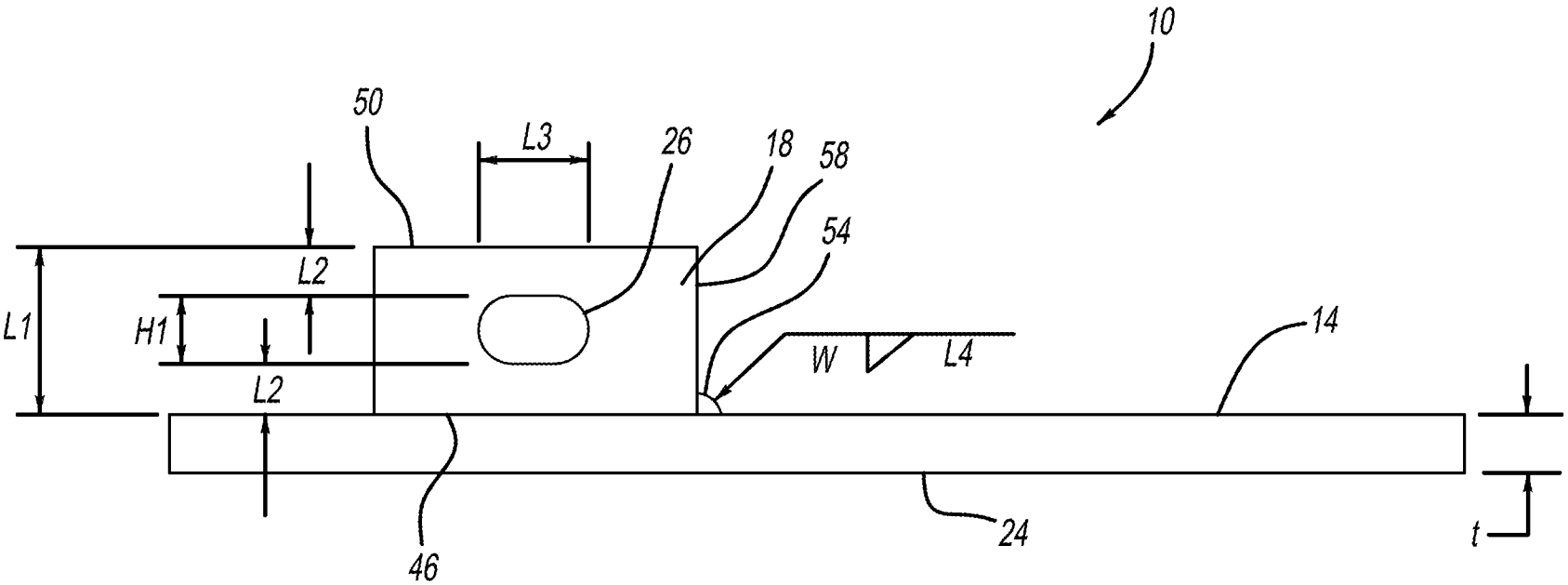
FIG. 2 is a side view of the baseplate of FIG. 1.

Additionally referring to FIG. 2, the plate 14 may have a thickness t that is determined based on the weight of the system being anchored and based on required seismic calculations, in this case by the California Office of Statewide Health Planning and Development (OSHPD). For example only, the thickness t may be 5/16 inch (in.) or 3/8 in. Further, the size and shape of the plate 14 may be determined by the OSHPD calculations. For example, the plate 14 may have a polygon shape with a plurality of flat sides 24 that may mate with other planar surfaces such as adjacent equipment, walls, or floors when mounting the seismic baseplate 10. Lastly, the size and spacing of the bores 22 for receiving the screw anchors may be determined such that the strength of the wall or floor, (e.g., the strength of the concrete floor), is not exceeded.

Figure 5:
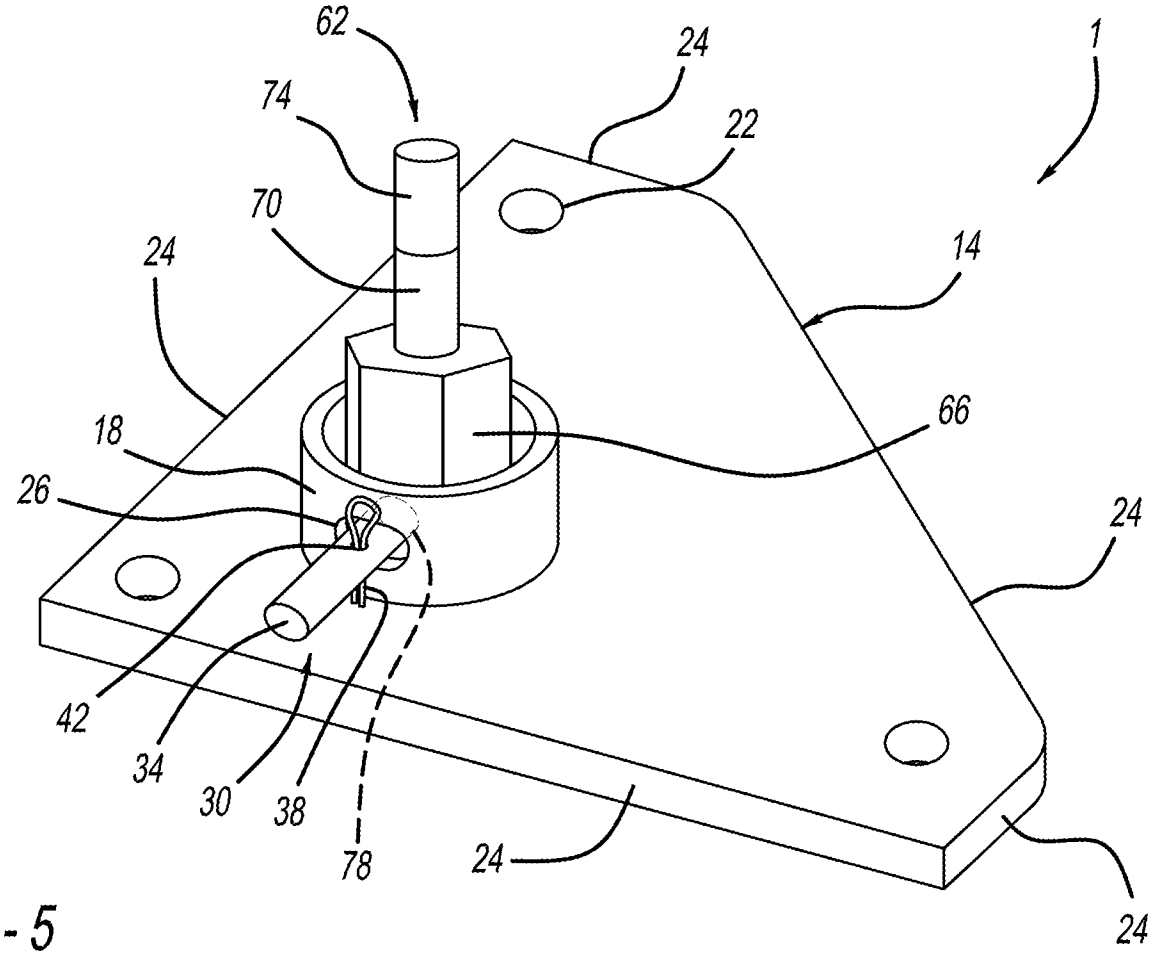
FIG. 5 is a perspective view of an anchoring system according to the present disclosure.

The socket 18 may further include a plurality of slots, or bores, 26 for receiving a fastener 30, such as a clevis pin (FIG. 5). The slots 26 may be positioned symmetrically on the socket 18, such that a rod 34 of the clevis pin 30 may pass through both slots 26 without bending. The clevis pin 30 is secured within the slots 26 by a pin, or clip, 38 passed through a bore 42 in the rod 34. While a clevis pin 30 is illustrated and discussed, it is understood by one skilled in the art that any known fastener may be used.

The socket 18 may be a 1.25 in., schedule 40 (SCH 40) pipe socket that is fixed on a first end 46 to the plate 14. A second end 50 may be a distance L1 from the first end 46, giving the socket 18 a length L1. The length L1 may be sized according to the project. For example only, the socket 18 may be a length L1 of 0.84 in.

The slots 26 may be a height H1 and may be positioned in a center of the socket 18 with a distance L2 on each side. The slots 26 may be determined based on the diameter of the clevis pin 30. For example only, for a 5/16 in. clevis pin, the slots 26 may have a height H1 of 0.34 in. The distance L2 on each side of the slots 26 is determined based on the length L1 of the socket 18 and the height H1 of the slots 26. For example only, the distance L2 on each side of the slots 26 may be 0.25 in.

The slots 26 may also have a length L3. The length L3 of the slots 26 may also be determined based on the diameter of the clevis pin 30. For example only, for a 5/16 in. clevis pin, the length L3 of the slots 26 may be 0.70 in. The length L3 of the slots 26 allows for tolerances and minor misalignment between the shelving and the anchored plates 14 during assembly. Often, when anchoring or mounting shelving, the post 90 may not line up perfectly concentric with the socket 18 after the plate 14 is anchored to the floor, wall, etc., and the tolerances allow for this minor misalignment.

The socket 18 may be formed of a material similar to the plate 14, such as steel, and may be fixedly engaged, such as through welding, to the plate 14. A weld 54 may extend around an outer wall 58 of the socket 18 at the intersection of the socket 18 and the plate 14. The weld 54 may be a fillet weld having a cross-section w and length L4. The cross-section w and length L4 may be adjusted based on the material of the plate 14 and socket 18, forces acting on the socket 18, and a circumference of the outer wall 58 of the socket 18. For example only, the cross-section w may be 1/8 in., and the length L4 may be within a range of 1.25-2.625 in.

Figure 3:
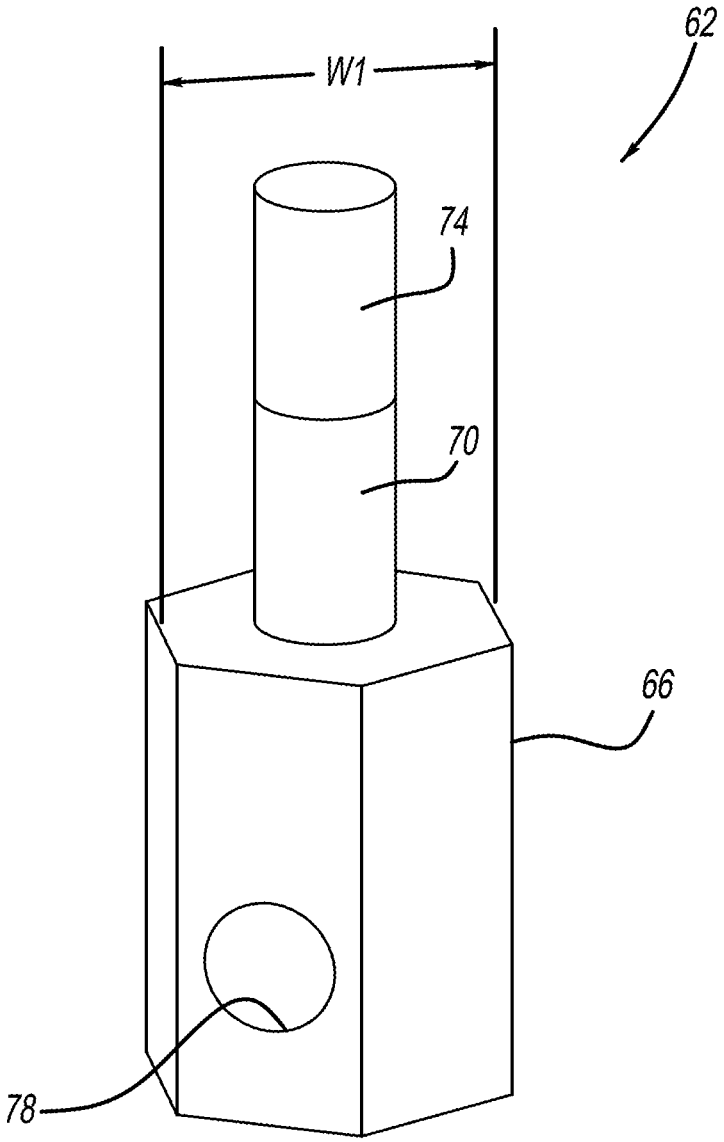
FIG. 3 is a perspective view of a leveler according to the present disclosure.
Figure 4:
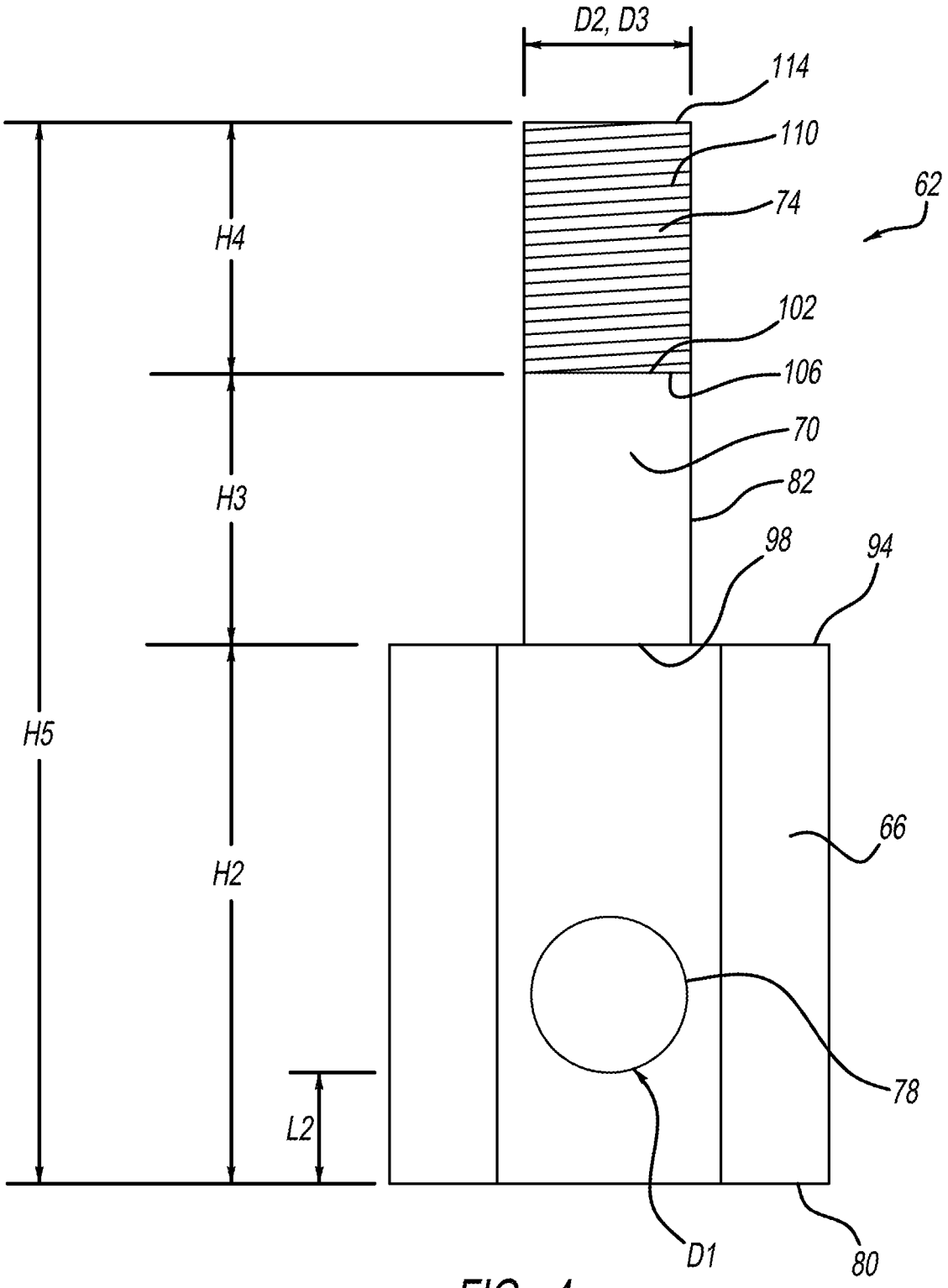
FIG. 4 is a side view of the leveler of FIG. 3.

Now referring to FIGS. 3 and 4, a leveler 62 of the anchoring system 1 is illustrated. The leveler 62 includes a head 66, a spacer 70, and a threaded portion 74. The head 66 may be a hexagonal, or other polygon-shaped, portion and may be formed from a metal, such as steel. The head 66 may further include a bore, or hole, 78, extending through the head 66, for receiving the fastener 30. A diameter D1 of the bore 78 may be sized based on the diameter of the fastener, or clevis pin, 30. For example only, the diameter D1 may be 0.34 in. for a 5/16 in. clevis pin. The bore 78 may further be positioned to align with the slots 26 in the socket 18. For example only, the bore 78 may be positioned the distance L2 (for example, 0.25 in) from a base 80 of the head 66.

A width W1 of the leveler 62 may be sized to fit within the socket 18 and such that the leveler 62 may be adjusted with a wrench during installation. For example only, the width W1 of the leveler 62 may be 7/8 in. such that the leveler 62 may be adjusted during installation with a 7/8 in. wrench.

The head 66 may have a height H2. The height H2 may be determined based on the length L1 of the socket 18. For example, if the length L1 of the socket 18 is 0.84 in., the height H2 of the head 66 may be 1.22 in., so that the head 66 extends 0.375 in. (3/8in.) above the second end 50 of the socket 18. The 0.375 in. extension above the second end 50 of the socket 18 allows enough clearance for the head 66 to be adjusted using a wrench after installation within the socket 18.

The spacer 70 may be a cylindrical portion and may be formed from a similar material as the head 66, such as a metal or steel. The spacer 70 is fixedly engaged to the head 66, for example, by welding. The spacer 70 may have a smooth surface 82 and a diameter D2 that is less than the width W1 of the head 66. For example only, the diameter D2 may be 3/8 in. The spacer 70 may function to provide a predetermined amount of space between a foot 86 of a post 90 (FIG. 7) and a top 94 of the head 66. Spacer 70 keeps the threads 74 from being exposed below foot 86 of post 90. This is important in foodservice applications where exposed threads are considered a dirt trap and health hazard. The spacer 70 is not required in non-food applications, but may be present for other reasons.

The spacer 70 may include a first end 98 and a second end 102 opposite the first end 98. The spacer 70 may include a height H3 extending from the first end 98 to the second end 102, and the height H3 may be determined based on a desired amount of space between the foot 86 of the post 90 and the top 94 of the head 66. For example only, the height H3 may be 0.62 in. The spacer 70 may be positioned in the leveler 62 between the head 66 and the threaded portion 74, such that the first end 98 is engaged to the top 94 of the head 66 and the second end 102 is engaged to a first end 106 of the threaded portion 74.

The threaded portion 74 may be a cylindrical portion and may be formed from a similar material as the head 66 and the spacer 70, such as metal or steel. The threaded portion 74 is fixedly engaged to the spacer 70, or a portion of the spacer 70. A diameter D3 of the threaded portion 74 is approximately or generally the same as diameter D2 of the spacer 70 and less than width W1. For example only, the diameter D3 may be 3/8 in.

The threaded portion 74 further includes threads 110. The threaded portion 74 may receive the post 90 (FIG. 7), and the threads 110 may engage the post 90 and retain the post 90 on the threaded portion 74. The threads 110 may be sized based on threads in the post 90. For example only, the threads 110 may be 3/8-16 threads.

The threaded portion 74 may include a height H4 extending from the first end 106 to a second end 114. The height H4 may be determined based on the length of a threaded portion of the post 90. For example only, the height H4 may be 0.56 in.

An overall height H5 of the leveler 62 may be equivalent to the sum of the individual heights H2, H3, and H4. For example only, the overall height H5 may be 2.40 in.

Figure 6:
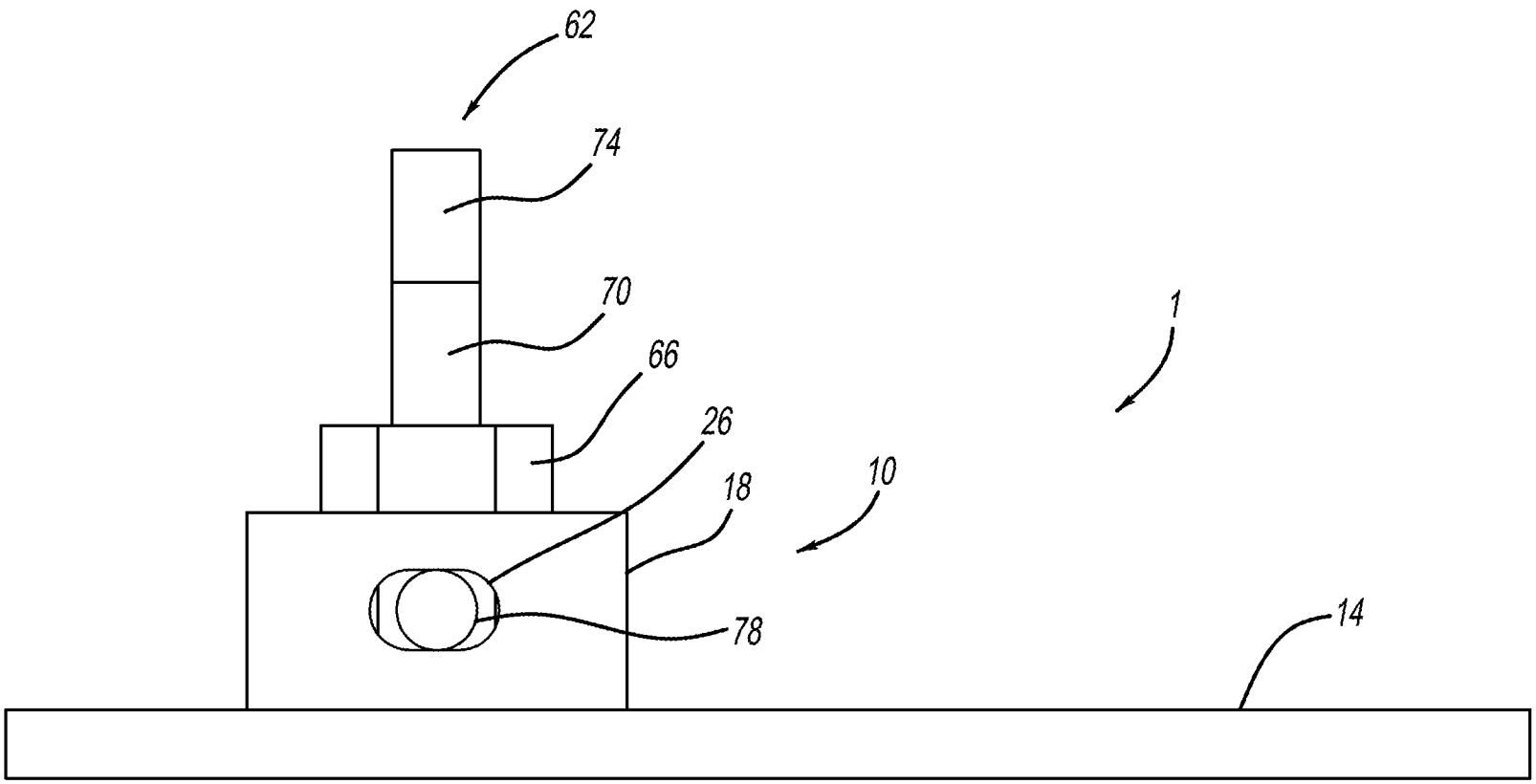
FIG. 6 is a side view of the anchoring system of FIG. 5.
Figure 7:
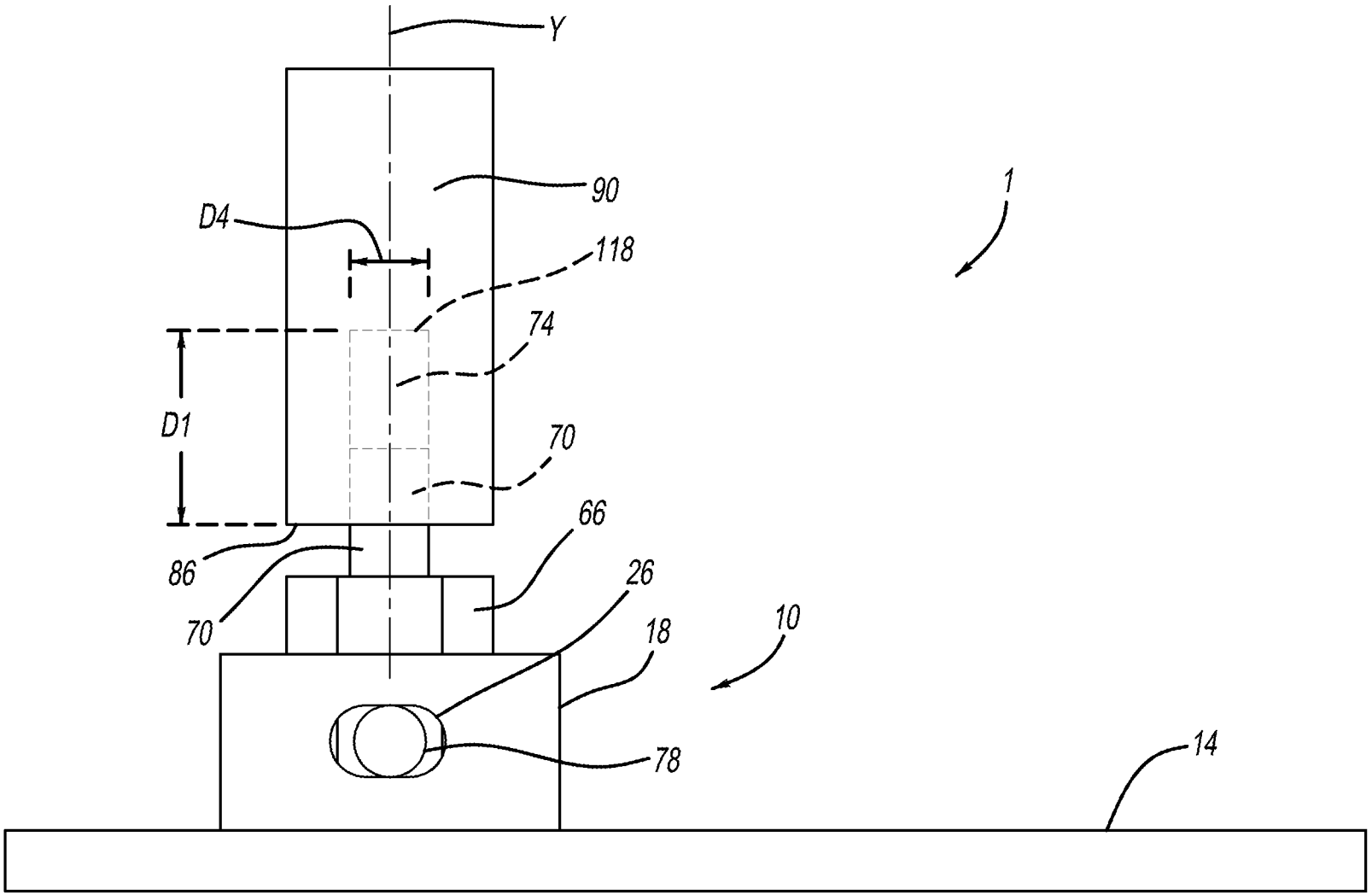
FIG. 7 is a side view of the anchoring system of FIG. 5 engaged with stationary equipment.

Now referring to FIGS. 5-7, the assembled anchoring system 1 including the baseplate 10 and leveler 62 is illustrated. As best shown in FIGS. 5 and 6, the head 66 of the leveler 62 is positioned within the socket 18 such that the bore 78 on the head 66 aligns with the bores 26 on the socket 18. The fastener 30, for example the clevis pin, may be inserted through the bores 78 and 26 to secure the leveler 62 within the socket 18. The rod 34 of the clevis pin 30 is inserted through both bores 26 and bore 78 (FIG. 5). The pin 38 is inserted through the bore 42 in the rod 34 to secure the rod 34 and clevis pin 30 within the bores 26 and bore 78, and thus secure the leveler 62 within the socket 18.

As assembled, the head 66 of the leveler 62 extends a predetermined length above the socket 18 such that the head can be adjusted with a wrench during installation. For example only, as previously discussed, the head 66 may extend 0.375 in. (⅜ in.) above the second end 50 of the socket 18. The head 66 of the leveler 62 may be adjusted to level the post 90 in relation to the plate 14 and floor or wall. A wrench (for example, a ⅞ in. wrench) may be used to adjust the head 66 before the clevis pin 30 is inserted through the bores 26 and 78. For example only, the adjustment may be 1/31 in. (a result of 180° rotation and 16 threads per inch thread).

The post 90 may include an interior bore 118 extending a depth D1 along an axis Y longitudinally down the length of the post 90. The interior bore 118 may have a diameter D4 equal to, or slightly greater than, the diameters D2 and D3 such that the threaded portion 74 and spacer 70 may be received within the interior bore 118. For example only, the diameter D4 may be ⅜ in. The interior bore 118 may include threads (not illustrated) that mate with the threaded portion 74 of the leveler 62 and retain the post 90 on the leveler 62. The threads (not illustrated) of the interior bore 118 may be designed to mate with the threads 110 of the threaded portion 74. For example only, the threads of the interior bore 118 may be ⅜-16 threads.

When assembled, the foot 86 of the post 90 may be kept a minimum distance from the top 94 of the head 66 depending on the height H3 of the spacer 70, the height H4 of the threaded portion 74, and the depth D1 of the bore 118. For example only, if the height H3 is 0.62 in, and the height H4 is 0.56 in., the depth D1 may be 0.97 in. to leave a minimum distance of 0.21 in. between the post 90 and the top 94 of the head 66.

After assembly of the post 90 to the leveler 62 and the leveler 62 to the plate 14, the post 90 may be leveled by rotating head 66 of the leveler 62 clockwise or counterclockwise (for example, using the ⅞ in. wrench) to adjust the position of the threaded portion 74 within the bore 118. Once all posts 90 and seismic baseplates 10 have been assembled and leveled, the clevis pin 30 may be inserted in the bores 26 and 78 of each seismic baseplate 10.

While the post 90 is illustrated as a cylindrical post, it will be understood to those skilled in the art that the post 90 may be any size or shape of post, such as cylindrical, triangular, hexagonal, or any other size or shape. The post 90 may also be of any material, such as metal or plastic.

Figure 8:
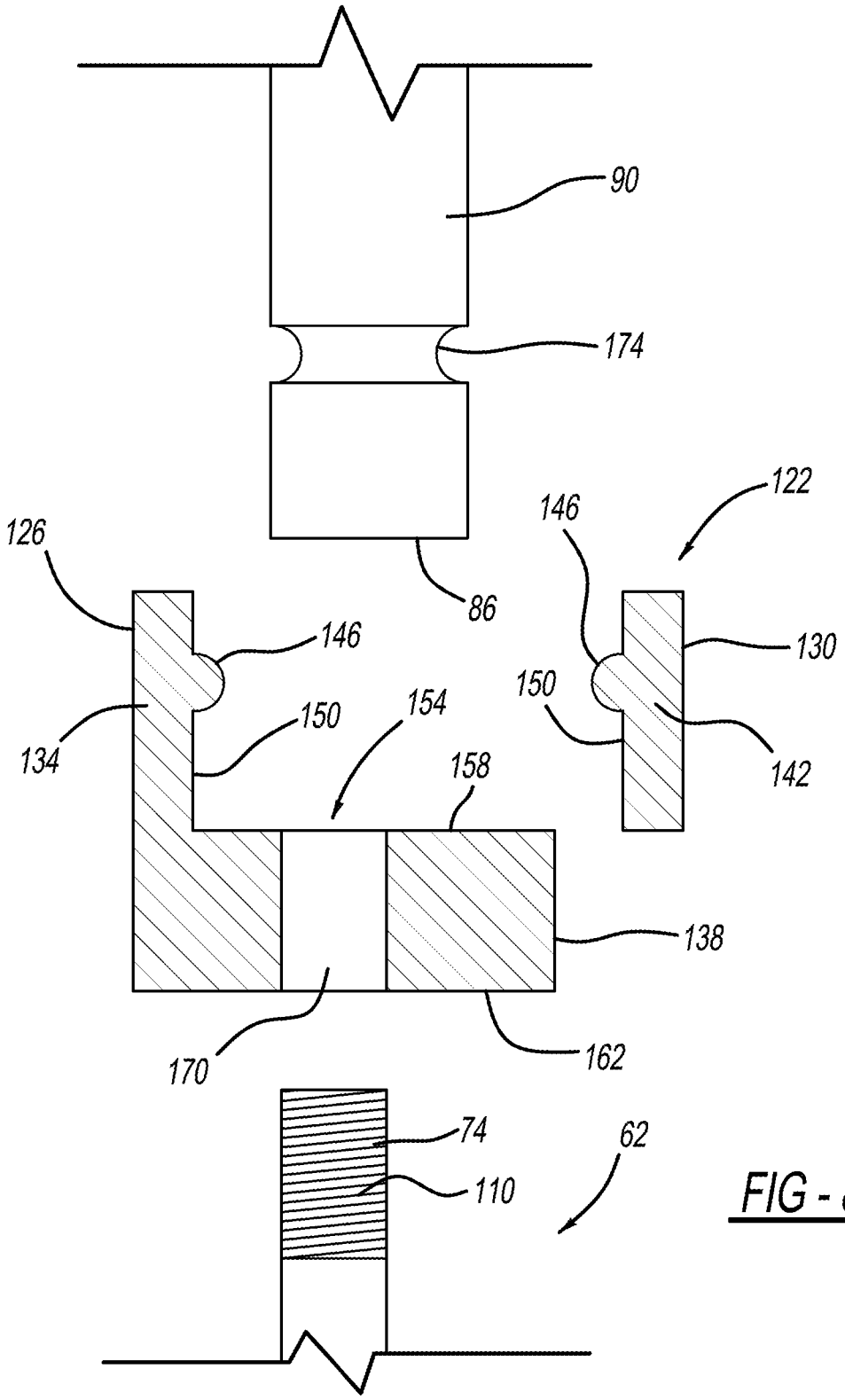
FIG. 8 is a front view of another embodiment of the anchoring system according to the present disclosure.
Figure 9B:
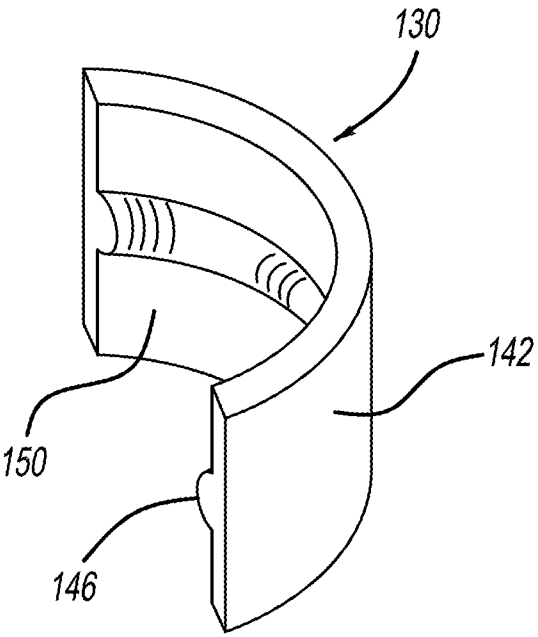
FIGS. 9A-9B are perspective views of the threaded accessory of the anchoring system in FIG. 8.
Figure 9A:
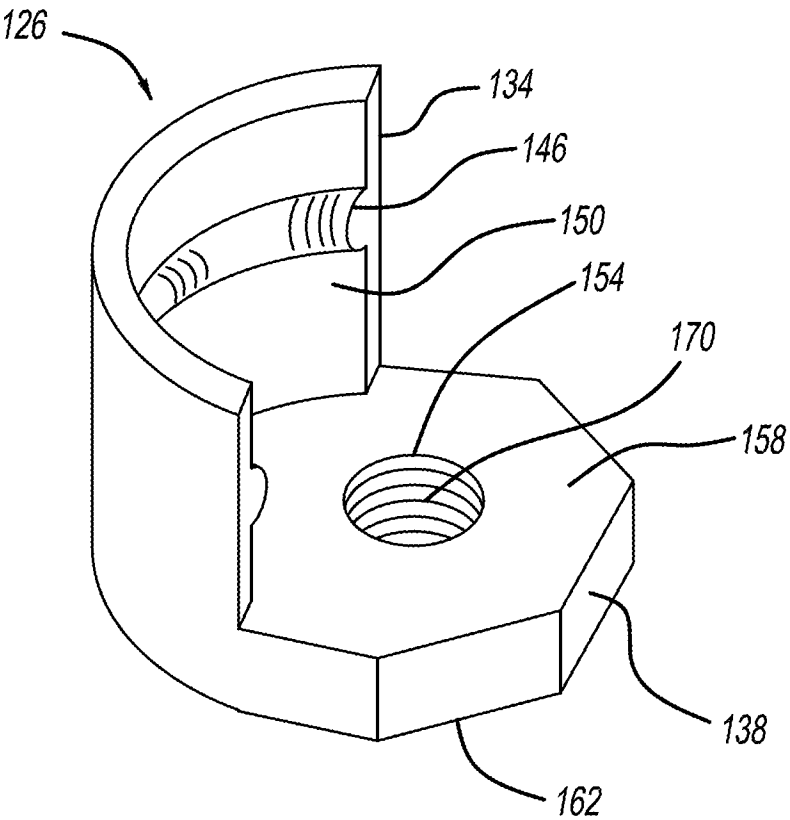

In an alternate embodiment, the threaded portion within the bore 118 of the post 90 may be provided by a threaded accessory 122 positioned on the foot 86 of the post 90 as illustrated in FIGS. 8 and 9A-9B. The threaded accessory 122 may further include two portions 126, 130. Portion 126 (FIGS. 8 and 9A) may include a wall 134 and a base 138. Portion 130 (FIGS. 8 and 9B) may include a wall 142 that mates with the wall 134 on portion 126 to, together, form a cylindrical, or tubular, threaded accessory 122 that receives the post 90. A ridge 146 may surround a circumference of an inner wall 150 of the portions 126, 130 of the threaded accessory 122.

The base 138 of the portion 126 further includes a through-bore 154 extending from a top 158 to a bottom 162 and being sized to receive the threaded portion 74 of the leveler 62. For example only, the through-bore 154 may have a diameter of approximately ⅜ in. An interior wall 166 of the through-bore 154 may include a threaded portion 170 that engages with the threaded portion 74 of the leveler 62 similarly to the method previously described in relation to other embodiments. For example only, the threaded portion 170 may include ⅜-16 threads, to mate with the threads 110 of the threaded portion 74.

The post 90 may further include a groove 174 around a circumference of the post 90 that engages with the ridge 146 when the threaded accessory 122 is positioned on the post 90 to locate the threaded accessory 122 on the post 90. The portions 126, 130 may clamp together around the post 90 to secure the portions 126, 130 to the post 90. When the portions 126, 130 are clamped around the post 90, the foot 86 of the post 90 may mate with the top 158 of the base 138. Thus, by using the threaded accessory 122, different sided and shaped posts may be fitted with the threaded accessory 122 and used with the same leveler 62.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A system for securing a shelving unit to an immovable structure comprising:

a mount configured to be secured to the immovable structure and comprising a base and a socket fixed to the base, the socket comprising a 1.25 in. diameter, schedule 40 pipe socket having a plurality of symmetrically positioned slots, wherein two slots of the plurality of slots are opposed to one another along a respective axis passing through the two slots;

a leveler positioned within the socket and including a head, a male-threaded portion and a spacer, the spacer fixedly engaged to the head and the male-threaded portion and having a smooth outer surface;

a vertical support post for the shelving unit including an interior bore formed therein at a lower vertical end of the support post, the interior bore including a female-threaded portion configured for engaging and receiving the male-threaded portion of the leveler to retain the support post on the leveler; and a fastener passing through two slots of the plurality of slots of the socket and securing the leveler to the socket;

wherein the spacer provides a predetermined amount of space between the lower vertical end of the support post and a top of the head such that the male-threaded portion is located within the interior bore and is not exposed below the lower vertical end of the support post;

wherein the leveler is rotatable to change a height of the support post in relation to other posts of the shelving unit, and wherein the support post further includes an upper vertical end opposite the lower vertical end, the support post engaged to the leveler only at the lower vertical end.

2. The system of claim 1, wherein the head is a hexagonal portion that is formed of a metal and includes a bore extending through the head for receiving the fastener; wherein the spacer is generally cylindrical, is formed of a metal and has a diameter that is less than a diameter of the head; and wherein the male-threaded portion is generally cylindrical, is formed of a metal and has a diameter that is the same as a diameter of the spacer and less than a diameter of the head.

3. The system of claim 1, wherein the base is fixed to a wall or a floor.

4. The system of claim 3, wherein the base is formed of metal.

5. The system of claim 4, wherein the socket is formed of a metal.

6. The system of claim 5, wherein the socket is fixedly engaged to the base through welding, and the weld is a fillet weld extending around an outer wall of the socket at an intersection of the socket and the base.

7. The system of claim 1, wherein the base includes a plurality of bores for receiving fixation devices for securing the base to a stationary structure.

8. The system of claim 1, wherein the base is of a polygon shape with a plurality of flat sides that mate with one or more planar surfaces of a stationary structure.

9. The system of claim 1, wherein the fastener is a clevis pin.

10. The system of claim 1, wherein a height of the leveler extends at least 0.375 inches above a length of the socket.

11. The system of claim 1, wherein the system is configured as a seismic anchoring system to secure the shelving unit to an immovable structure, especially during seismic activity.

12. The system of claim 1, wherein the fastener includes a rod and a clip, and the leveler includes a third bore, such that the rod passes through the two slots of the plurality of slots and the third bore to retain the leveler in the position within the socket, and the rod receives the clip to retain the rod within the two slots and third bores.

13. The system of claim 1 further comprising an adapter configured to be positioned at the lower vertical end of the support post, the adapter comprising: a second base; a bore in the second base comprising a second female-threaded portion engageable with the male-threaded portion of the leveler; and an inner wall comprising a ridge; and wherein the ridge is configured to engage a circumferential groove on the support post engageable with the ridge when the adapter is positioned at the lower vertical end of the support post.

14. The system of claim 13 wherein the adapter further comprises a first portion and a second portion operable to clamp together around the support post.

15. A system for anchoring a shelving unit to a stationary structure, the system comprising:

a mount configured to be secured to the stationary structure and comprising a base and a socket, the socket having a wall and being fixed to the base and including first and second apertures through the wall, the first and second apertures being spaced symmetrically apart on opposite sides of the socket;

a leveler including:

a head portion having a first end being disposed substantially inside the socket and a second end extending outside of the socket, the head portion including a first bore extending therethrough, the first bore being aligned with the first and second apertures of the socket;

a spacer portion fixedly engaged to the head portion and having a smooth outer surface, the spacer portion being located entirely outside of the socket; and a male-threaded portion extending from the spacer portion such that the male-threaded portion is located on an opposite side of the spacer portion from the head portion, the male-threaded portion positioned entirely outside of the socket and having a diameter being substantially the same as a diameter of the spacer portion and less than a width of the head portion;

a shelving unit comprising a plurality of vertically-oriented longitudinally extending support posts, each of the plurality of support posts having a lower vertical end and an upper vertical end opposite the lower vertical end, wherein only a lower vertical end of at least one support post of the plurality of support posts is secured to the stationary structure by the mount;

wherein the at least one support post comprises a second bore extending into the respective lower vertical end of the at least one support post, the second bore comprising a female-threaded portion configured to receive and engage the male-threaded portion of the leveler to attach the at least one support post to the leveler; and a removable fastener passing through the first and second apertures of the socket and the first bore of the head portion and attaching the leveler to the mount and inhibiting rotation of the leveler within the socket of the mount;

wherein the spacer portion provides a predetermined amount of space between the lower vertical end of the at least one support post and a top of the head portion such that the male-threaded portion is located within the second bore and is not exposed below the lower vertical end of the at least one support post;

wherein when the fastener is removed from the first and second apertures and the first bore, the leveler is rotatable relative to the mount and is operable to adjust a vertical position of the male-threaded portion within the female-threaded second bore of the at least one support post, thereby adjusting a vertical height of the at least one support post relative to the stationary structure and the other of the plurality of support posts of the shelving unit.

16. The system for anchoring a shelving unit to a stationary structure according to claim 15, wherein the head portion is a hexagonal portion that is formed of a metal and the male-threaded portion is a cylindrical portion that is formed of a metal.

17. The system for anchoring a shelving unit to a stationary structure according to claim 16, wherein the male-threaded portion includes ⅜-16 threads.

18. The system for anchoring a shelving unit to a stationary structure according to claim 15, wherein the base is fixed to a wall or a floor.

19. The system for anchoring a shelving unit to a stationary structure according to claim 18, wherein the base includes a plurality of bores for receiving fixation devices for securing base to the wall or floor.

20. The system for anchoring a shelving unit to a stationary structure according to claim 19, wherein the base is of a polygon shape with a plurality of flat sides that mate with one or more planar surfaces of the wall or floor.

21. The system for anchoring a shelving unit to a stationary structure according to claim 15, wherein a height of the leveler extends at least 0.375 inches above a length of the socket.

22. The system for anchoring a shelving unit to a stationary structure according to claim 15, wherein the socket is fixedly engaged to the base through welding, and the weld is a fillet weld extending around the wall of the socket at an intersection of the socket and the base.

23. The system for anchoring a shelving unit to a stationary structure according to claim 15, further comprising an adapter configured to be positioned at the lower vertical end of the at least one support post, the adapter comprising: a second base; a bore in the second base comprising a second female-threaded portion engageable with the male-threaded portion of the leveler; and an inner wall comprising a ridge; and wherein the ridge is configured to engage a circumferential groove on the at least one support post when the adapter is positioned at the lower vertical end of the at least one support post.

24. The system for anchoring a shelving unit to a stationary structure according to claim 23, wherein the adapter further comprises a first portion and a second portion operable to clamp together around the at least one support post.

25. The system for anchoring a shelving unit to a stationary structure according to claim 15, wherein only one support post of the plurality of support posts is secured to the stationary structure.

26. The system for anchoring a shelving unit to a stationary structure according to claim 25, wherein the system is configured as a seismic anchoring system to secure the shelving unit to an immovable structure, especially during seismic activity.

* * * * *